United States Patent [19]

Smith

[11] Patent Number: 4,989,732

[45] Date of Patent: Feb. 5, 1991

[54] PRESSURE UNITIZED PACK OF HANDLED PLASTIC FILM SACKS

[75] Inventor: Graham Smith, Walworth, N.Y.

[73] Assignee: Mobil Oil Corporation, Fairfax, Va.

[21] Appl. No.: 475,572

[22] Filed: Feb. 6, 1990

[51] Int. Cl.[5] ..... B65D 27/10

[52] U.S. Cl. ..... 206/554; 383/9; 383/37; 383/903

[58] Field of Search ..... 206/495, 554, 806; 383/7, 9, 17, 903, 37; 493/196, 203, 204

[56] References Cited

U.S. PATENT DOCUMENTS

| | | | |
|---|---|---|---|
| 4,476,979 | 10/1984 | Reimann et al. | 383/903 |
| 4,480,750 | 11/1984 | Dancy | 206/554 |
| 4,529,090 | 7/1985 | Pilon | 206/554 |
| 4,562,925 | 1/1986 | Pistner | 206/554 |
| 4,785,938 | 11/1988 | Benoit, Jr. et al. | 383/9 |
| 4,883,450 | 11/1989 | Benoit | 493/196 |

*Primary Examiner*—David T. Fidei

*Attorney, Agent, or Firm*—Alexander J. McKillop; Charles J. Speciale; James P. O'Sullivan, Sr.

[57] ABSTRACT

A pack of thermoplastic film bags, which are in at least approximate registration, each bag having a bottom, front and rear bag walls connected by way of gussetted side walls, a bag mouth, double film loop handles at opposite ends of the bag mouth, the handles being integral extensions of the walls; the pack having pack suspension and dispensing means in association with the handles about intermediate between the top and the base of the handles; and the area of the film of each of the handles of the pack adjacent to suspension means being releasably-pressure bonded together, in the absence of an adhesive.

6 Claims, 1 Drawing Sheet

PRESSURE UNITIZED PACK OF HANDLED PLASTIC FILM SACKS

The present invention relates to unitized packs of thermoplastic film bag structures having integral vertically extended handles.

DESCRIPTION OF PRIOR ART

U.S. Pat. No. 4,165,832 to Kuklies et al, discloses packs of thermoplastic grocery sacks wherein the individual bags are designed to be held in registration by being thermally welded together at a suspension tab member which extends from the center region of the bag mouth. While this type of unitization is effective in maintaining the sacks in secure uniform registration at the bag mouth region, they do not keep the handles in registration. Such a bag pack is structured to be suspended from the center of the pack and it is awkward during dispensing and bag filling to deal with the loose unsecured handles particularly in bag packs containing over 100 bags in the pack.

U.S. Pat. No. 4,106,734 to Walitalo is directed to handleless plastic bags which are held in registration by employing a small adhesive area below the bag mouth of the front ply of each bag so that it contacts the back ply of the next bag in the stack. Thus, in addition to maintaining the bags in registration at the bag mouth region this feature also will assist in at least partially opening the bag mouth as each preceding filled bag is removed from the pack. Among the disadvantages of this system is the additional cost of applying the adhesive and the fact that the bags not having handles are inconvenient to transport.

U.S. Pat. No. 4,796,759 to Schisler is directed to a pack of thermoplastic film handled grocery sacks. A hole is present in each handle so as to receive a rod therethrough designed to support the bag pack by the handles. A center support tab extends from the mouth of each bag and the tabs are joined together by welding or gluing to secure the bags in a pack. A line of perforations separate the support tab from the bag mouth. Below the perforation line of each bag is a "glued or welded localized zones 9" which ensures connection between the rear wall of one bag and the front wall of the next bag and so on through the bag pack. Above this point 9, the welded-together support tabs maintain the bags in registration and the localized glued or welded zones 9 assists in opening the bags during the dispensing and loading of the same. This construction also has the disadvantage that no provision is made for maintaining the handles in registration.

U.S. Pat. No. 4,676,378 issued to Baxley et al is directed to a pack of thermoplastic film grocery sacks having integral handles extending therefrom. Each handle has an arcuate cut surrounding a tab-like member therein, so as to receive a support rod through the cut which supports the bag pack from the handles during bag dispensing and filling. During manufacture of the bag pack a heated member fuses the individual orifice tabs together in order to make it easier to thread the bag handles onto the support rods. In order to accomplish this result, a complex and intricate cutting and hot pin welding device is required. It also makes little sense to melt-bond the tabs together when the handles can be melt-bonded together almost anywhere outside of the tab area.

U.S. Pat. No. 4,811,417 to Prince et al shows a bag pack having vertical slit support handles therein, wherein the handles are melt-bonded together at the top by means of a heated pin device.

It is a principal object of the present invention to provide a pack of thermoplastic film grocery sacks having integrally extended handles with support means in association with the handles and providing means for maintaining the handles and the bags in secure registration prior to support from the handle region of the pack.

SUMMARY OF THE INVENTION

The present invention provides a pack of lay flat thermoplastic film bags, said bags being stacked in at least approximate registration, each bag comprising a bottom, front and rear bag walls connected by way of gussetted side walls, a bag mouth, double film loop handles at opposite ends of the bag mouth, said handles being integral extensions of said walls;

said pack having pack suspension and dispensing means in association with said handles; and an area of the film of each of the handles of said pack and optionally of the bag mouth region being releasably-pressure bonded together, in the absence of an adhesive.

DETAILED DESCRIPTION OF THE INVENTION

Figure 1:
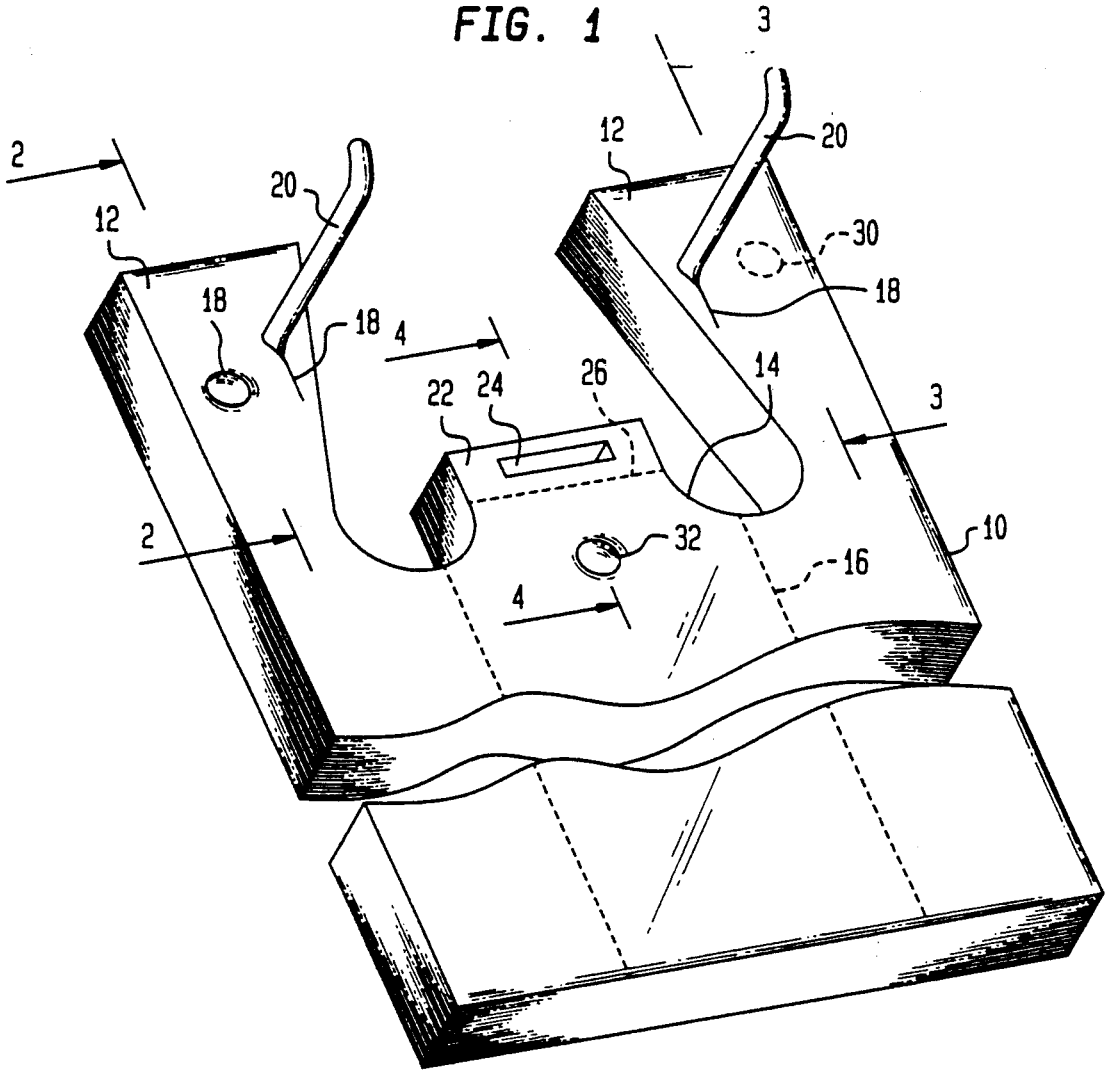
FIG. 1 is a perspective view of an assembled pack of bags shown suspended from support rods.

One form of bag structure of the present invention, shown in FIG. 1 of the accompanying drawing, generally comprises a pack of superimposed lay flat registered bags. These bags are fabricated from a flattened gussetted thermoplastic tube which has been sealed across the width thereof top and bottom at a bag-length distance apart. The thermoplastic material is typically one of the species of polyethylene, its copolymers or blends. Such sealed, flattened, gussetted, thermoplastic tubes are known in the art as sealed pillowcases. Such pillowcases are stacked one upon the other until the number of pillowcases desired in the pack is reached. Thereafter, a suitable cutting means removes thermoplastic film from all of the pillowcases at one end thereof. The cutting means is designed to create integral double loop handles and a bag mouth such as the type shown in FIG. 1.

Thus bag pack 10 is made up of a plurality of individual thermoplastic film grocery sacks positioned in registration one upon the other. At the top thereof, each bag has double film loop handles 12 at opposite ends of an open mouth region 14. The handles have double film loops by virtue of the gussetted construction of the bag. Dotted line 16 illustrates a preferred inward extent of the gussets on both sides of the bag.

Each handle is shown as having a slit orifice 18 which accommodates handle support rods 20 which extend through the slit orifices.

FIG. 1 also shows a suspension tab 22 which can be in association with the bag mouth region of the bag in different ways. For example, a tab of the shape shown can be attached to the front panel of the bag by means of a perforation line 26. An identical tab 22 can likewise be attached to the back panel of the bag. The tabs of all of the bags are then placed in registration and the tabs are bonded together in some suitable manner so that a suspension orifice 24 is in alignment through all of the tabs.

The perforation line 26, which connects the front panel of the bag with the front suspension tab, is an optional structure. The bags can be fashioned so that front tab 22 is not attached at all to the front panel of the bag. In this arrangement, access to the bag mouth of the front panel can be accomplished without there being any impediment to accessing the bag mouth. A quick movement of the hand down across the front tab 22 will access the bag mouth since the edge will not be connected to front tab 22.

For certain manufacturing reasons, it may be more practical to permit the front panel at the bag mouth region to be connected to the front suspension tab 22 at a few points instead of a continuous perforation line. If, for example, the front panel of the bag in the bag mouth region is attached to the front suspension tab 22 at two very narrow points, then during transport of the pillowcase during manufacture, this will prevent air from entering between the front panel and the back panel of the pillowcase and disturbing an orderly manufacture.

On the other hand, if air disturbance is not a problem or can be adequately coped with, then the front panel need not be attached at all to tab 22. This is what is known as having a "front side free" structure. As indicated above, the advantage of this arrangement is that it permits rapid dispensing and filling of the individual bags. The bagger can immediately access the front of the bag with a wipe of the hand since it does not have to be severed from tab 22.

It is also to be understood that, in certain instances employing a handle support system, the bags need not have a bag mouth support arrangement at all. That is, tabs 22 need not be present in the structure at all.

Figure 2:
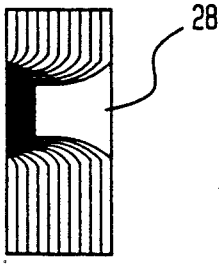
FIG. 2 shows a section of the left handle region cut away along line 2—2 of FIG. 1.

Located in each handle and optionally in the upper center region near the bag mouth, are compressed areas 28, 30 and 32. These areas, which can vary in size and shape, comprise regions that have been forcibly compressed so as to bring the areas of film into extremely intimate, face-to-face contact. The force of compression should be such that substantially all air space is eliminated between film regions being compressed. With respect to area 28 of the left-hand handle of the bag pack, pressure has been applied from the top while the bag handles have been supported by a flat, yielding support surface, e.g., Teflon, hard rubber, etc. This resulted in the creation of a depression or partial nesting arrangement of the layers of film in the handle stacks. Obviously, the outermost regions will be involved in a stretching of its film as shown in FIG. 2. The area of compression shown at 28 can be approximately a circle of any convenient size, e.g., from 1/32 inch to over 1 inch in diameter. The effect of this compression will be that the layers of film making up the stack of handles will stay in registration after compression and during normal reasonable handling, during shipment to a customer and up to the time the bagger threads the bag handle onto support rods 20. This is accomplished in the absence of an added adhesive between any of the layers of film. Thereafter, the force needed to remove a bag from the pack, will, without significant resistance, permit de-nesting of the compressed areas.

It is to be understood that the language "...releasably-pressure bonded together, in the absence of an adhesive..." or its equivalent, means that the superimposed areas of films are pressure squeezed together to achieve intimate face-to-face contact. One bag can be released from the next in the pack with little or no resistance encountered and yet the stacked bags will tend to remain in registration. The term "adhesive" is used in its usual sense to include the sticky, tacky, etc., material of the prior art.

Figure 3:
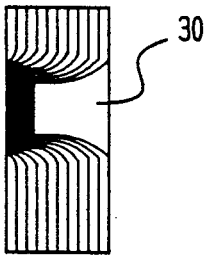
FIG. 3 shows a section of the right handle taken along the line 3—3 of FIG. 1.

The right-hand handle region of the bag pack shows compressed region 30 but in the reverse relationship of that of compressed area 28. Here the handles of the pack of bags have been compressed by a compression means extending upwardly from the support surface with an unyielding, platelike member offering resistance against this compression from a point overlying the right-hand handle of the first or outermost bag of the bag pack. This region is shown in cross-section in FIG. 3.

Reversing the direction from which the compression force is applied regarding the right-hand handle is merely optional. It would be used to militate against film layers farthest from the pressure source, as in the left-hand side, from being displaced because they may not be nested. Applying all the pressure points from the same side obviously is less complicated and bringing the film areas into compressed contact is what keeps the layers in registration even without nesting all the way through.

Figure 4:
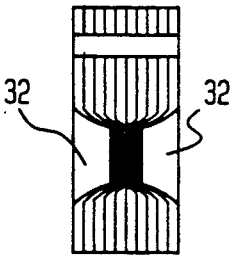
FIG. 4 shows a section of the center region of the tab and bag mouth of the bag pack taken along line 4—4 of FIG. 1.

Optionally, compressed regions 32 are shown located near the center of the bag mouth and in this instance the compressed areas 32 were brought about by applying equal areas of pressure from opposite directions so as to result in the equal and opposite nested regions 32 as shown in FIG. 4.

The beneficial effect of the compressed regions will be understood to operate to keep the bags of the bag pack in a fixed approximate registration during transport to the ultimate user who can then thread the bag packs onto the support members without difficulty. It, of course, is not necessary to employ the three different arrangements of compressed areas as indicated above; one of the same kind in each handle will suffice. The compression fusion may be caused by several different sized or shaped pressure probes which result in nesting of the film layers. A relatively large probe, e.g., ¼ inch or greater diameter, will cause the outer film areas, which are subjected to the greatest degree of stretching during nesting to still remain intact, i.e., the film is not pierced in this region. If the pressure pin is relatively small, e.g., ⅛ inch or smaller in diameter, some or all of the film layers be pierced but pressure bonding will still occur in this area. The small diameter and any subsequent hole size would not have any significant adverse affect on handle or bag performance.

The compression areas can be placed in the pillowcases after they have been stacked to the desired stack height prior to converting the pillowcases into bag packs or they may be placed in the handles and bag mouth regions simultaneously with the formation of the handles and bag mouth region of the bags.

The described bags can be made of any of the usual thermoplastic film material employed for such bags. A suitable thermoplastic film material is generically polyethylene which includes low, medium, and high density polyethylene. In addition, a copolymer of ethylene and another alpha-olefin can be employed as the film material.

It is to be understood that suspension orifices 18 of the handles can be in the handles or extending as tabs from the handles. It is essential that the orifices be located sufficiently below the tops of the handles 34 so that the loop handles can open to a meaningful extent on handle support rods 20. Ideally, orifices midway between the tops and bottoms of the handles will permit the loop to spread open on the support rod with the result that the front panel of the bag will be separated from the rear panel to easily accommodate filling the bag. Placing an orifice at the top of the handles shows a lack of appreciation of the structural features contributing to efficient bag suspension and bagging. The orifice can be of any shape which does not materially weaken the handles under usual supermarket loads. While circular, partial circle, teardrop shape, triangular, slit shape can be used, a substantially curved slit is preferred.

The support rods for the bag pack must extend a sufficient distance beyond the first bag of a full bag pack, e.g., a bag pack of 125 bags of 0.65 mil film. The sufficient distance is a length that will permit the flattened loop handles to expand and consequently separate the front panel of the bag from the rear panel to permit bagging to begin.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A pack of thermoplastic film bags, said bags being in at least approximate registration, each bag comprising a bottom, front and rear bag walls connected by way of gussetted side walls, a bag mouth, double film loop handles at opposite ends of the gag mouth, said handles being integral extensions of said walls;

said pack having pack suspension and dispensing means in association with said handles about intermediate between the top and the base of said handles; and an area of the film of each of the handles of said pack adjacent to said suspension means being releasably-pressure bonded together, in the absence of an added adhesive so as to form a depression extending partially into the handles of said pack bringing the adjacent areas of said depression into intimate face-to-face contact, excluding substantially all air space from therebetween.

2. The pack of claim 1 wherein an area of film of each bag mouth region of said pack being releasably-pressure bonded together, in the absence of an adhesive so as to form another of said depression.

3. The pack of claim 1 wherein suspension and dispensing means is an orifice in association with the handles about intermediate between the top and the base of said handles.

4. The pack of claim 1 wherein each bag has a center tab in association with the front and rear bag panel at said bag mouth, all of the tabs being bonded together and containing a support member in association therewith.

5. A system for suspending and dispensing grocery sacks comprising in combination, a pack of thermoplastic film bags, said bags being in at least approximate registration, each bag comprising a bottom, front and rear bag walls connected by way of gussetted side walls, a bag mouth, double film loop handles at opposite ends of the bag mouth, said handles being integral extensions of said walls;

said handles having suspension orifices in association with therewith about intermediate the top and the base of said handles;

an area of film of each of the handles of said pack being releasably-pressure bonded together in the absence of an added adhesive so as to form a depression extending partially into the handles of said pack bringing the adjacent areas of said depression into intimate face-to-face contact, excluding substantially all air space from therebetween; and a pair of spaced-apart, elongated members supporting said bag pack through said orifices.

6. The system of claim 5 wherein said pack has center tabs in association with the center of each bag mouth, said tabs being bonded together and having support means in association therewith.

* * * * *